US007036649B2

(12) United States Patent
Yang et al.

(10) Patent No.: US 7,036,649 B2
(45) Date of Patent: May 2, 2006

(54) AUTO-BILL-DISPENSING MACHINE

(75) Inventors: Ya-Hui Yang, Taitung (TW); I-Chia Lin, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 143 days.

(21) Appl. No.: 10/421,820

(22) Filed: Apr. 24, 2003

(65) Prior Publication Data

US 2004/0212145 A1 Oct. 28, 2004

(51) Int. Cl.
*G07D 7/00* (2006.01)

(52) U.S. Cl. ..... 194/203; 194/206; 194/207; 194/344

(58) Field of Classification Search ..... 194/203, 194/206, 207, 344, 351, 347, 349; 232/44, 232/55, 56, 57, 57.5, 58–61; 379/145, 144.03; 193/DIG. 1; 209/534
See application file for complete search history.

(56) References Cited

U.S. PATENT DOCUMENTS 5,018,193 A * 5/1991 DeArkland ..... 379/145
5,156,250 A * 10/1992 Parish et al. ..... 194/348
5,195,739 A * 3/1993 Watabe ..... 271/207
5,242,041 A * 9/1993 Isobe ..... 194/207
5,325,952 A * 7/1994 McGinley et al. ..... 194/203
5,769,200 A * 6/1998 Meyer et al. ..... 194/203
5,806,649 A * 9/1998 Walsh et al. ..... 194/203
5,813,509 A * 9/1998 Boxall et al. ..... 194/203
6,000,521 A * 12/1999 Jung ..... 194/206
6,021,881 A * 2/2000 Wild ..... 194/203
6,105,747 A * 8/2000 Uemizo et al. ..... 194/203
6,349,810 B1 * 2/2002 I-Chia ..... 194/203
6,550,600 B1 * 4/2003 Faes et al. ..... 194/203
6,668,998 B1 * 12/2003 Mosteller et al. ..... 194/203

* cited by examiner

*Primary Examiner*—Donald P. Walsh
*Assistant Examiner*—Jeffrey A. Shapiro

(57) ABSTRACT

An auto-bill-dispensing machine is provided. The auto-bill-dispensing machine comprises bill receiver having a plurality of security hooks positioned axially between two positioning plates formed on the two sides of the upper chassis of the bill receiver, and the security hooks are against within a plurality of blocking grooves of the lower chassis to block the bill passage. When the bill enters into the bill passage and being held against on the security hooks, the security hooks of the bill receiver will be out of the blocking groove of the lower chassis to let the bill pass through, and after the bill passes the security hooks, the security device will return to the original position to make the security hooks support within the blocking groove of the lower chassis to prevent the bill being pulled back by a string, a tape, a steel wire or a glued metallic plate.

7 Claims, 6 Drawing Sheets

AUTO-BILL-DISPENSING MACHINE

BACKGROUND OF THE INVENTION

1. The Field of the Invention

The present invention relates to an auto-bill-dispensing machine, and more particularly relates to a bill receiver of an auto-bill-dispensing machine comprising a plurality of security hooks positioned axially between two positioning plates formed on the two sides of an upper chassis of the bill receiver, and the security hooks are positioned within and against a plurality of blocking grooves of the lower chassis to block the bill passage.

2. Description of the Related Art

With the rapid advancement and development in electronic industry, the auto-bill-dispensing machines (such as card dispensing machine, ticketing machine or auto-changing machine) are installed in many public places for satisfying the requirement of the consumers as convenience and prompt service. The service provided by these machines are not only for substantially reducing the labor cost but also more acceptable to the consumers for the convenience provided. However, the general automatic vending machines will be under the supervision only in the routine manual storage check-up or maintenance, and when they are not under the supervision by the authorized party, the cards or bills therein can be stolen by using several methods. Referring to the vending machine of a prior art as shown in FIG. 6, which indicates that the conventional bill receiver comprises a frame A, on a side of the frame A has a receiving slot A1 for receiving bills, and on the upper and lower side of the bill passage positioned inside of the frame A fixed with a circuit board B for identifying the bills and a motor device C. Further, at the exit A2 positioned with a security plate D for preventing the bill being pulled out after accepting by the bill receiver A1. As bill is made of soft material and gets damage when being pulled by force, such destructive activity can also break down the operation of the bill receiver. And if a thief uses a harder material, for example, steel wire, metallic plate or alike, to try to pull out the bill, the security device of the conventional is incapable of preventing the bills from being stolen. According, it is highly desirable to improve the structure of the bill receiver to overcome the defects of the prior art.

SUMMARY OF THE INVENTION

Accordingly, in the view of the foregoing, the present inventor makes a detailed study of related art to evaluate and consider, and uses years of accumulated experience in this field, and through several experiments, to create a new structure of a bill receiver for an auto-bill-dispensing machine in order to improve the security of the auto-bill-dispensing machine to effectively prevent the bills from being stolen.

According to one aspect of the present invention, a bill receiver comprising a plurality of security hooks positioned axially between two positioning plates formed on the two sides of the upper chassis of the bill receiver is provided, and the security hooks are positioned within and against a plurality of blocking grooves of the lower chassis to block the bill passage.

According to another aspect of the present invention, when the bill enters into the bill passage and is being held against the security hooks, the security hooks of the security device will be out of the blocking groove of the lower chassis to let the bill pass through, and after the bill passes the security hooks, the security device will return to the original position to make the security hooks support within the blocking groove the lower chassis, and thus preventing the bill from being pulled back by using a string, a tape, a steel wire or a glued metallic plate adhering onto the bill.

BRIEF DESCRIPTION OF THE DRAWING

For a more complete understanding of the present invention, reference will now be made to the following detailed description of preferred embodiments taken in conjunction with the accompanying drawings, in which.

DETAILED DESCRIPTION OF PREFERRED EMBODIMENTS

Figure 1:
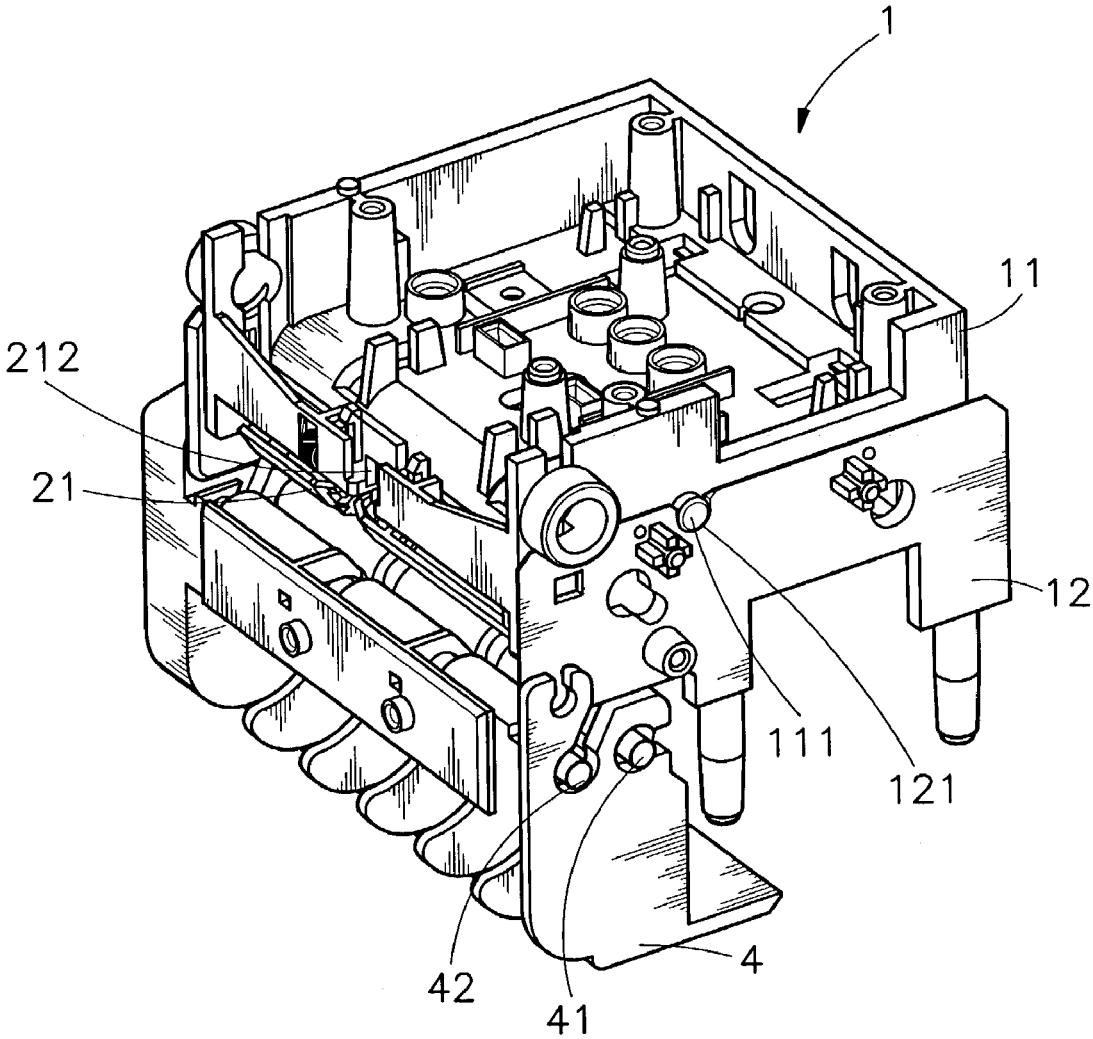
FIG. 1 is an elevational view of an auto-bill-dispensing machine of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
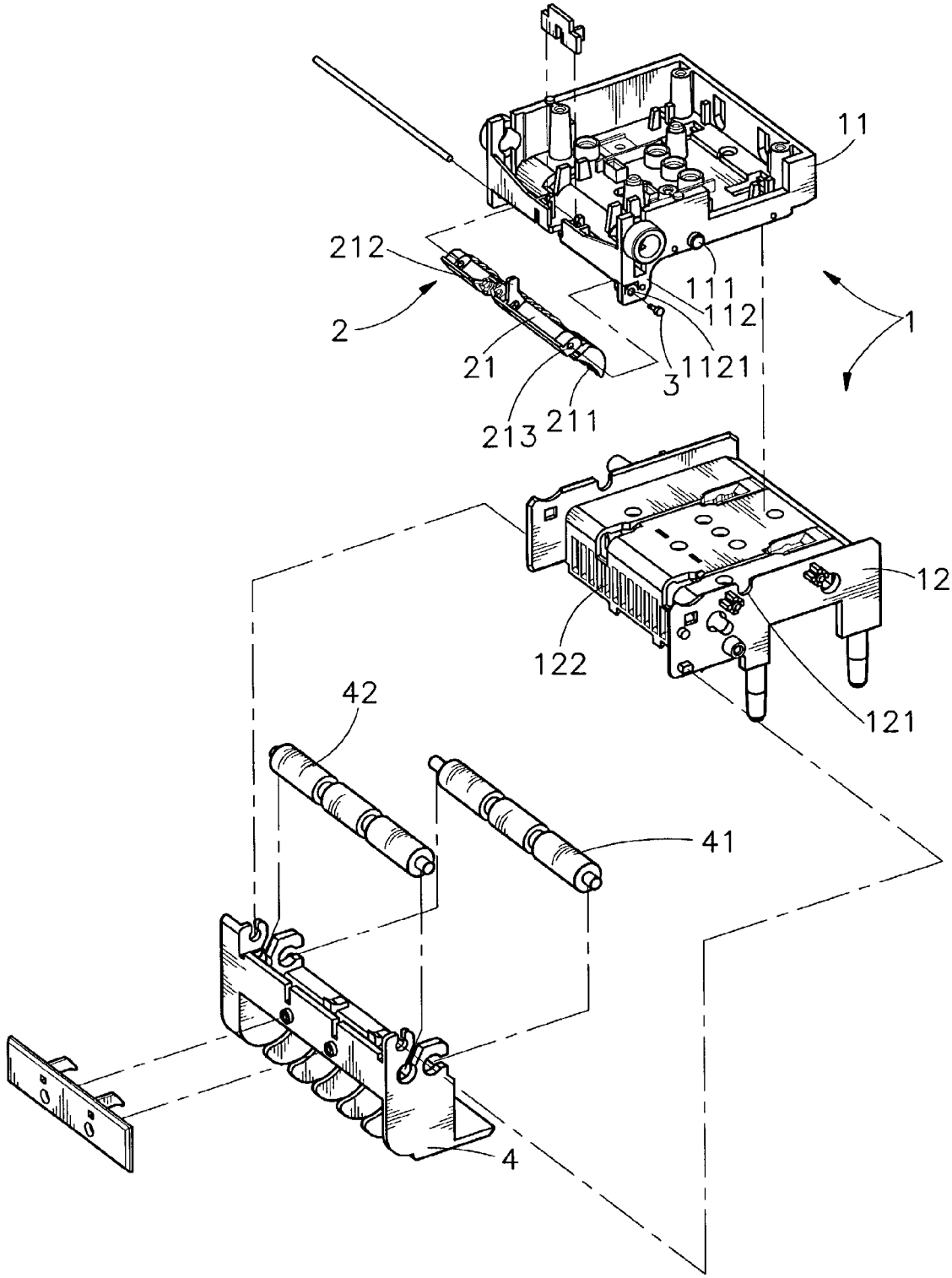
FIG. 2 is an exploded view of the auto-bill-dispensing machine of the present invention.
Figure 3:
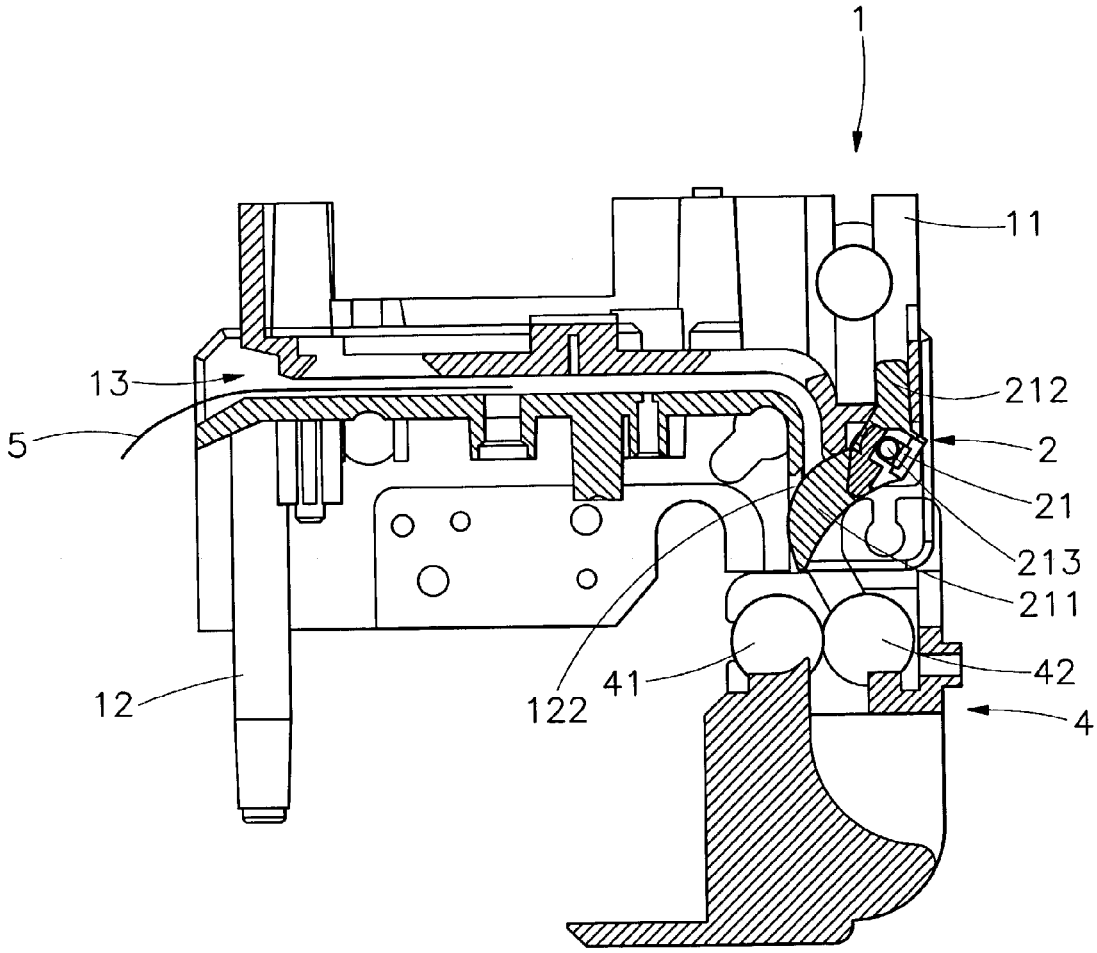
FIG. 3 is a sectional view showing before the bill entering into the bill receiver of the present invention.

Referring to FIGS. 1, 2 and 3, the auto-bill-dispensing machine of the present invention comprises a bill receiver 1 and a security device 2 positioned axially within the bill receiver 1. The bill receiver 1 comprises an upper chassis 11 and a lower chassis 12, and on each side of the upper chassis 11 comprises a protrusion 111, and on each corresponding side of the lower chassis 12 comprises a fitting groove 121, thus the protrusions 111 of the upper chassis 11 can fit into the fitting groove 121 of the lower chassis 12 forming a bill passage 13 in between the upper chassis 11 and the lower chassis 12. Further, at the frontal flange of each side of the upper chassis 11 extends into a positioning element 112 having a through hole 1121, and a plurality of blocking grooves 122 is formed at the central region of the lower chassis 12.

The security device 2 comprises a base 21, and at the bottom flange of the base 21 has a plurality of arched pointed security hooks 211. Further, on a top face of the base 21 comprises a projected weight block 212, and a plurality of through holes 213 is formed on the two sides of the base 21.

The feature provided by the above described embodiment is to fix the security device 2 between the positioning elements 112 on the two sides of the upper chassis 11, and by using an axle element 3 to penetrate through the through hole 1121 of the positioning element 112 and the through hole 213 of the base 21 to further position the security device 2, thus the security device 2 is able to rotate at an angle by using the axle element 3 as an axis.

Furthermore, the lower chassis 12 of the bill receiver 1 comprises a roller holder 4, and a first roller set 41 and a second roller set 42 are positioned on a top of the roller holder 4 axially positioned, and the first roller set 41 and the second roller set 42 on the roller holder 4 are supported against each other and are positioned at the exit of the bill passage 13.

Figure 4:
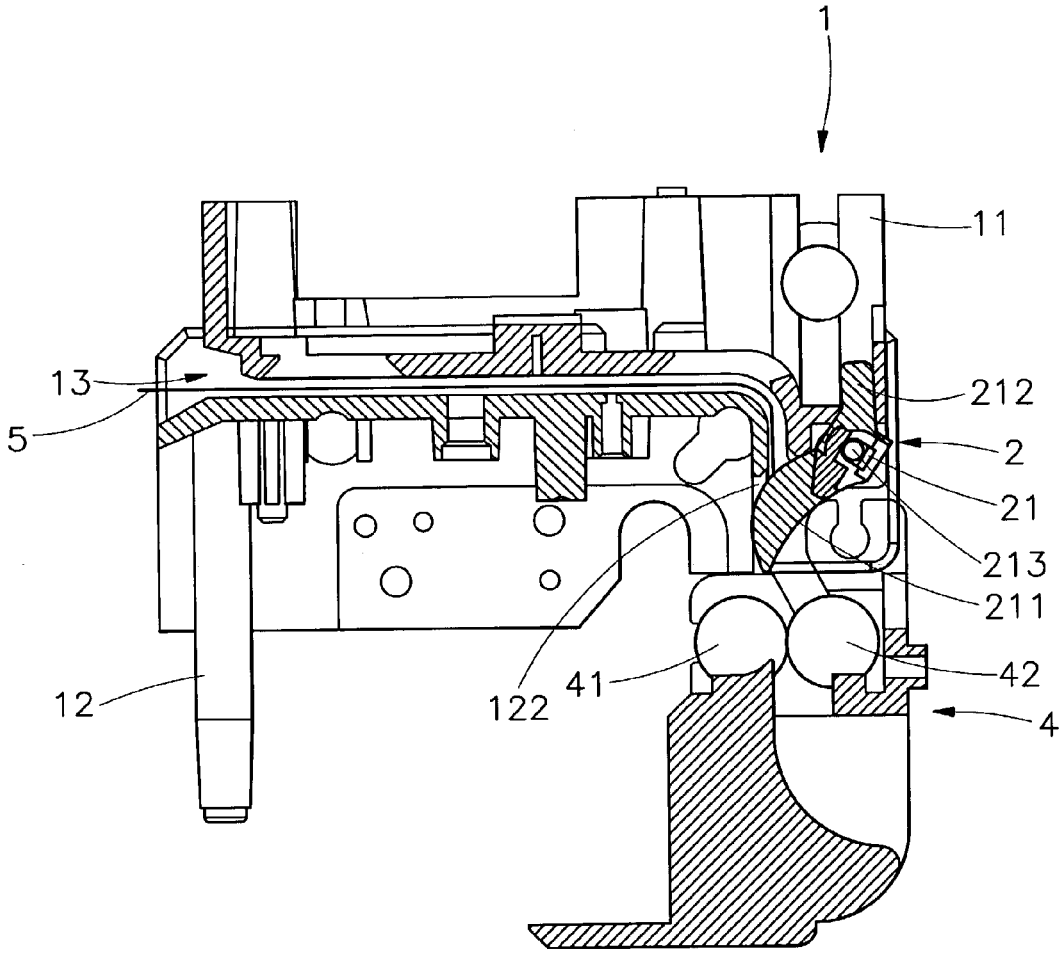
FIG. 4 is a sectional view showing when the bill entering into the bill receiver of the present invention.
Figure 5:
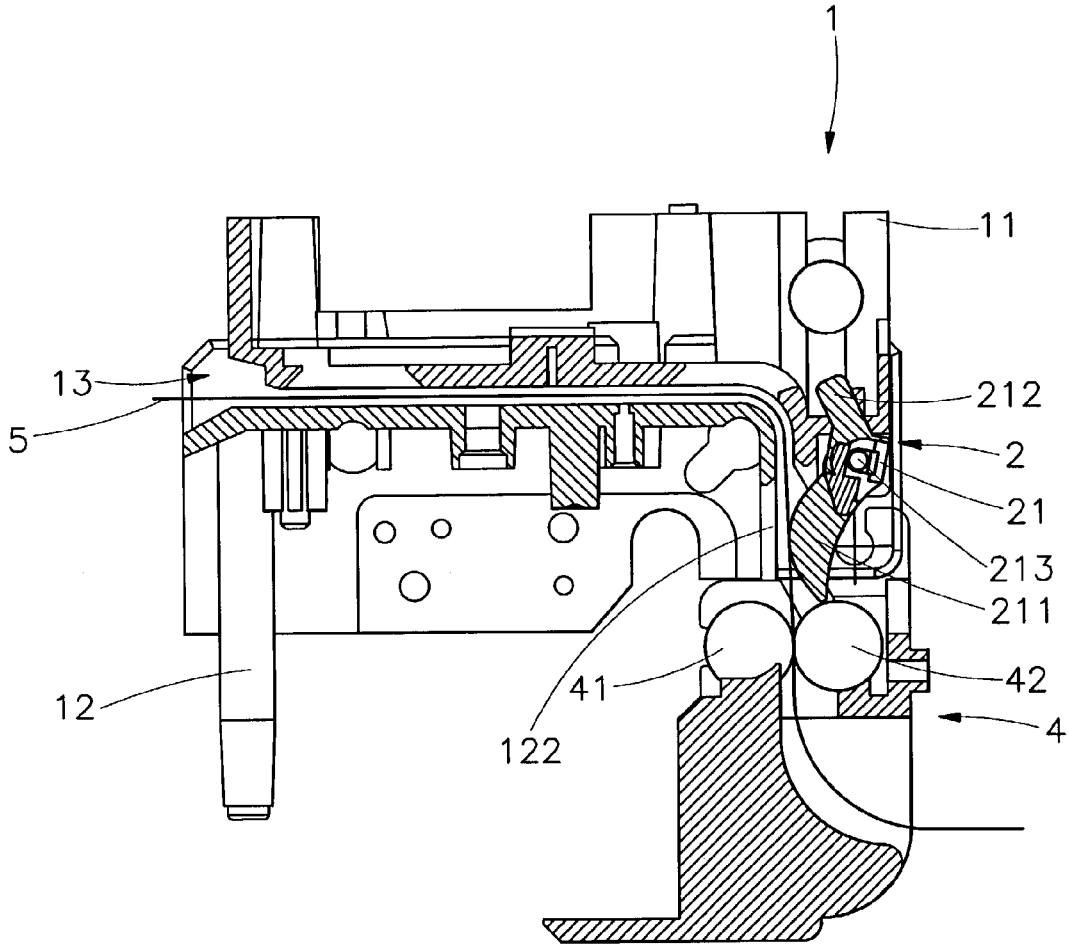
FIG. 5 is a sectional view showing after the bill entering into the bill receiver of the present invention.
Figure 6:
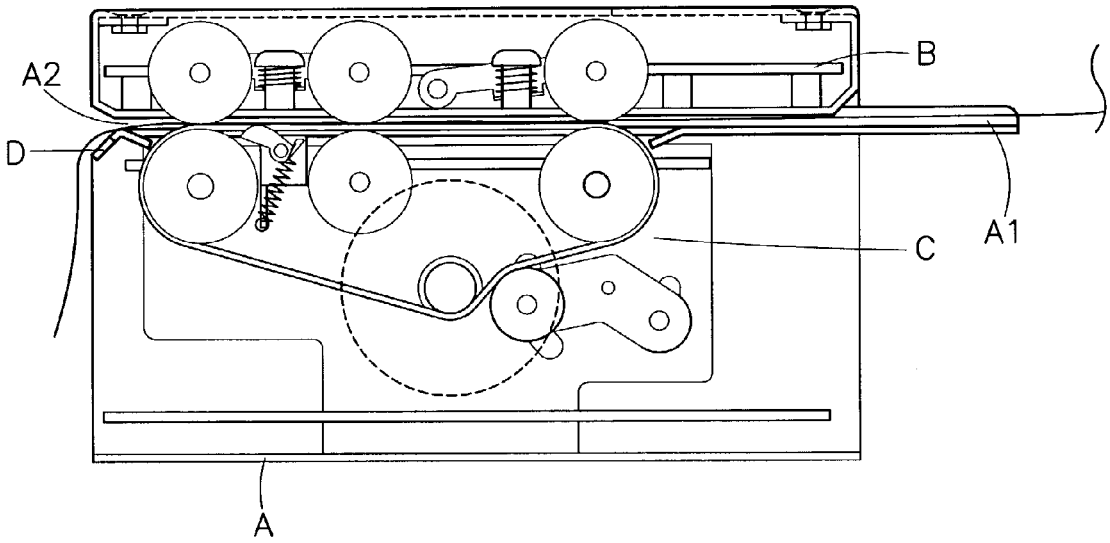
FIG. 6 is a sectional view of a conventional auto-bill-dispensing machine.

Referring to FIGS. 3, 4 and 5, the actual operation of the bill receiver of the present invention is described. Before operating the bill receiver 1, the security hooks 211 of the security device 2 are forced into the blocking groove 122 of the lower chassis 12 due to the weight of the weight block 212 under the gravitational force and thereby block the bill passage 13. When the bill 5 passes through the bill passage 13 of the bill receiver 1, as the bill 5 travels and reaches security hooks 211, the edge of the bill 5 pushes against the arched side of the security hooks 211 and makes the security hook 211 to rotate at an angle allowing the bill 5 to pass through the bill passage 13. After the bill 5 passes the security hooks 211, the security hooks 211 are again forced back into the blocking groove 122 due to the weight of the gravitational force block 212 and thereby blocks the bill passage 13 so that if a thief tries to use a string, a tape, a steel wire, a glued metallic plate or alike to steal the bill 5, the security hooks 211 will effectively blocks the bill 5 from being removed by the string, tape, steel wire, glued metallic plate or alike.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

The invention claimed is:

1. An auto-bill-dispensing machine comprising:

a bill receiver comprising an upper chassis and a lower chassis, wherein between said upper chassis and lower chassis forms a bill passage, a frontal flange on each side of said upper chassis forms a positioning element and a plurality of blocking grooves is positioned at a central region of said lower chassis; and a security device positioned axially within the bill receiver, wherein said security device comprises a base, wherein said base is movable in between the two sides of said upper chassis and said positioning element, and a plurality of security hooks is pivotally disposed on an axle at a bottom flange of said base, wherein an upper end portion of said base comprises a weight block such that said security hooks block said bill passage due to said weight block under gravitational force and allow a banknote to pass through said bill passage in a first direction when a edge of said banknote pushes against said security hooks and after said banknote completely passes said security hooks, said security hooks block said banknote from being pulled out in a second direction opposite to said first direction.

2. The auto-bill-dispensing machine according to claim 1, wherein said positioning element of upper chassis has a through hole, and the two sides of said base of security device have through holes so that said positioning element and said base can be assembled together by using an axle element to penetrate through said through hole of said positioning element and said through holes of said base.

3. The auto-bill-dispensing machine according to claim 1, wherein said security hook of the security device is in an arched pointed shape.

4. The auto-bill-dispensing machine according to claim 1, wherein said lower chassis of bill receiver comprises a roller holder, and said roller holder has a first roller set and a second roller set.

5. The auto-bill-dispensing machine according to claim 4, wherein said first roller set and said second roller set are supported against each other.

6. The auto-bill-dispensing machine according to claim 4, wherein said first roller set and second roller set are made of a rubber material.

7. The auto-bill-dispensing machine according to claim 1, wherein a protrusion is formed on a side of said upper chassis, a fitting groove is formed on a side of said lower chassis such that said protrusion is secured into said fitting groove.

* * * * *